US008052180B1

(12) United States Patent
Lassen

(10) Patent No.: US 8,052,180 B1
(45) Date of Patent: Nov. 8, 2011

(54) TAMPER EVIDENT CARGO SEAL

(75) Inventor: David Lassen, Arnold, MD (US)

(73) Assignee: The United States of America as represented by the Director of the National Security Agency, Washington, DC (US)

( * ) Notice: Subject to any disclaimer, the term of this patent is extended or adjusted under 35 U.S.C. 154(b) by 940 days.

(21) Appl. No.: 12/069,006

(22) Filed: Jan. 24, 2008

(51) Int. Cl.
*B65D 27/30* (2006.01)

(52) U.S. Cl. ..... 292/307 A; 292/307 R

(58) Field of Classification Search ..... 70/55, 56, 70/307 A, 307 R
See application file for complete search history.

(56) References Cited

U.S. PATENT DOCUMENTS 5,120,097 A 6/1992 Fattori et al.
5,125,700 A 6/1992 Fattori et al.
5,568,951 A * 10/1996 Morgan ..... 292/307 A
6,331,022 B1 12/2001 Liroff
7,063,362 B1 6/2006 Liroff
7,201,410 B1 * 4/2007 Lassen ..... 292/307 R

* cited by examiner

*Primary Examiner* — Kristina Fulton
(74) *Attorney, Agent, or Firm* — Roshni Kurian

(57) ABSTRACT

A tamper-evident cargo seal is disclosed, comprising a pin that is passed through a hasp on a shipping container, a body member, a pair of parallel guide members, at least one security label blank, and a cover. One end of the pin is keyed. The body member has a slot through a side surface extending into the interior, and is keyed to receive the pin. Abutting the top surface of the body member are two parallel guide members, bounding an area comprising the top surface of the body member. One of the guide members also has a slot to allow the pin to engage the slot in the body member. One or two removable security label blanks are inserted between the guides after the pin is inserted into the slot, and a security label is affixed over the blanks. A cover engages the body and guide members to protect the label.

14 Claims, 9 Drawing Sheets

TAMPER EVIDENT CARGO SEAL

FIELD OF THE INVENTION

The present invention relates, in general, to closure fasteners and in particular, to a tamper-evident seal.

BACKGROUND OF THE INVENTION

Large cargo containers are widely used to transport cargo by sea, rail, and truck; and the significant value of this cargo requires that the cargo container be sealed from the time of loading until the container arrives at its destination. Typical cargo containers have a pair of doors that are secured with a locking pin through a hasp. Known in the art to secure cargo containers are simple padlocks, as well as strap and cable seals, some with RFID tags, such as those produced by the EJ Brooks Company.

Also known to persons skilled in the art are cargo bolt seals that enhance security by inserting and affixing a pin into a receiver with an adhesive. Removing the prior art pins requires cutting the bolt or pin part of the assembly with bolt cutting tools. The parts are not re-useable, and tampering attempts can be hidden within the plastic or metal housing of the permanent assembly. In addition, the pin is not easily customized for different applications and users.

U.S. Pat. Nos. 5,120,097 and 5,125,700, both entitled "SECURITY SEAL," discloses a two-part security seal comprising a spear shaped member that engages a receiver to lock the two parts together. The locked assembly cannot be disassembled without cutting or breaking the spear shaped member. Also included in the security seal is a conductive path that can be continuously monitored for continuity or checked before opening a container secured with the security seal, since the conductive path will break if someone tampers with the seal. The present invention is not limited to a single use security seal and does not include a conductive path for checking continuity (seal) of the device. U.S. Pat. Nos. 5,120,097 and 5,125,700 are hereby incorporated by reference into the specification of the present invention.

U.S. Pat. No. 6,331,022, entitled "CARGO SEAL," discloses a strap type cargo seal, with the strap having either one or, preferably, two coupling ends. The first end of the strap is inserted through a horizontal bar that holds the container doors shut, and the second end passes through the hasp. Each end is also serialized to deter tampering. As with all strap type seals, the strap must be cut to gain entry into the cargo container and is therefore not reusable. The present invention is not limited in this regard. U.S. Pat. No. 6,331,022 is hereby incorporated by reference into the specification of the present invention.

U.S. Pat. No. 7,063,362, entitled "SEAL ASSEMBLY FOR A CARGO CONTAINER," discloses a cable type cargo seal, with the cable wrapping around the horizontal bars typically attached to the doors of a cargo container to restrain the doors in a closed position, and having one end inserted through the hasp end of the closure mechanism and the other retained inside the cargo container. As with most security seals, the cable is serialized to deter tampering and readily identify replaced seals. As with the prior art seals mentioned above, opening the container requires destructively (cutting) removing the cable. The present invention is not limited in this regard. U.S. Pat. No. 7,063,362 is hereby incorporated by reference into the specification of the present invention.

There exists a need to securely lock cargo containers with a reusable cargo seal that also permits retention of serialized parts for forensic analysis of the sealing mechanism.

SUMMARY OF THE INVENTION

It is an object of the present invention to provide a reusable tamper indicating cargo seal to secure the opening to a container (bulk cargo container, door, back of truck) that uses a "hasp" method of closure.

After securing the hasp, a pin is inserted through the opening. The pin is positioned and slid into the body of the device of the present invention, and may be serialized. The body of the present invention includes guides for slideably inserting two removable security label blanks over the top surface of the body of the device. The removable security label blanks cover the pin and block the opening, thereby preventing the release of the pin from the body. If two removable security label blanks are used, each blank covers a portion of the area and the blanks interlock. A serialized tamper indicating label is placed over the removable security label blanks securing the removable security label blanks. A simple cover is placed over the body, the removable security label blanks and the tamper indicating label to offer protection from elements. When a user wishes to enter the container, the user may inspect the tamper indicating label for tampering, slit the label along the edge of the removable security label blanks (if two blanks are used), and slide the removable security label blanks out. The pin is then removed, and the doors may now be opened on the cargo container. The parts of the removable security label seal can now be inspected for detailed signs of tampering or substitution. Finally, the removable security label blanks can be flipped over and re-used.

DETAILED DESCRIPTION OF THE INVENTION

Figure 1A:
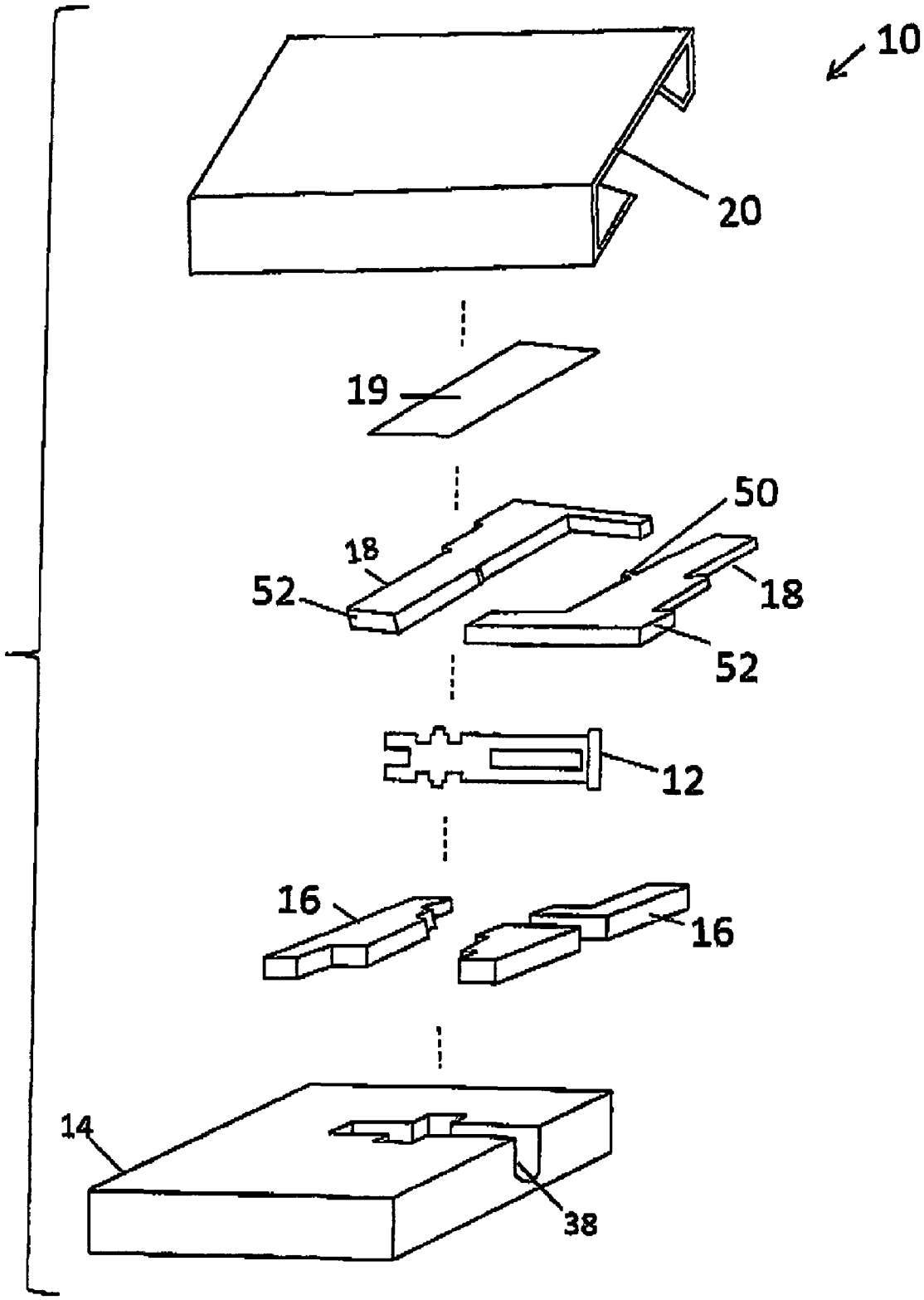
FIGS. 1A-1F depict the engagement of all the pieces of the present invention.
Figure 1B:
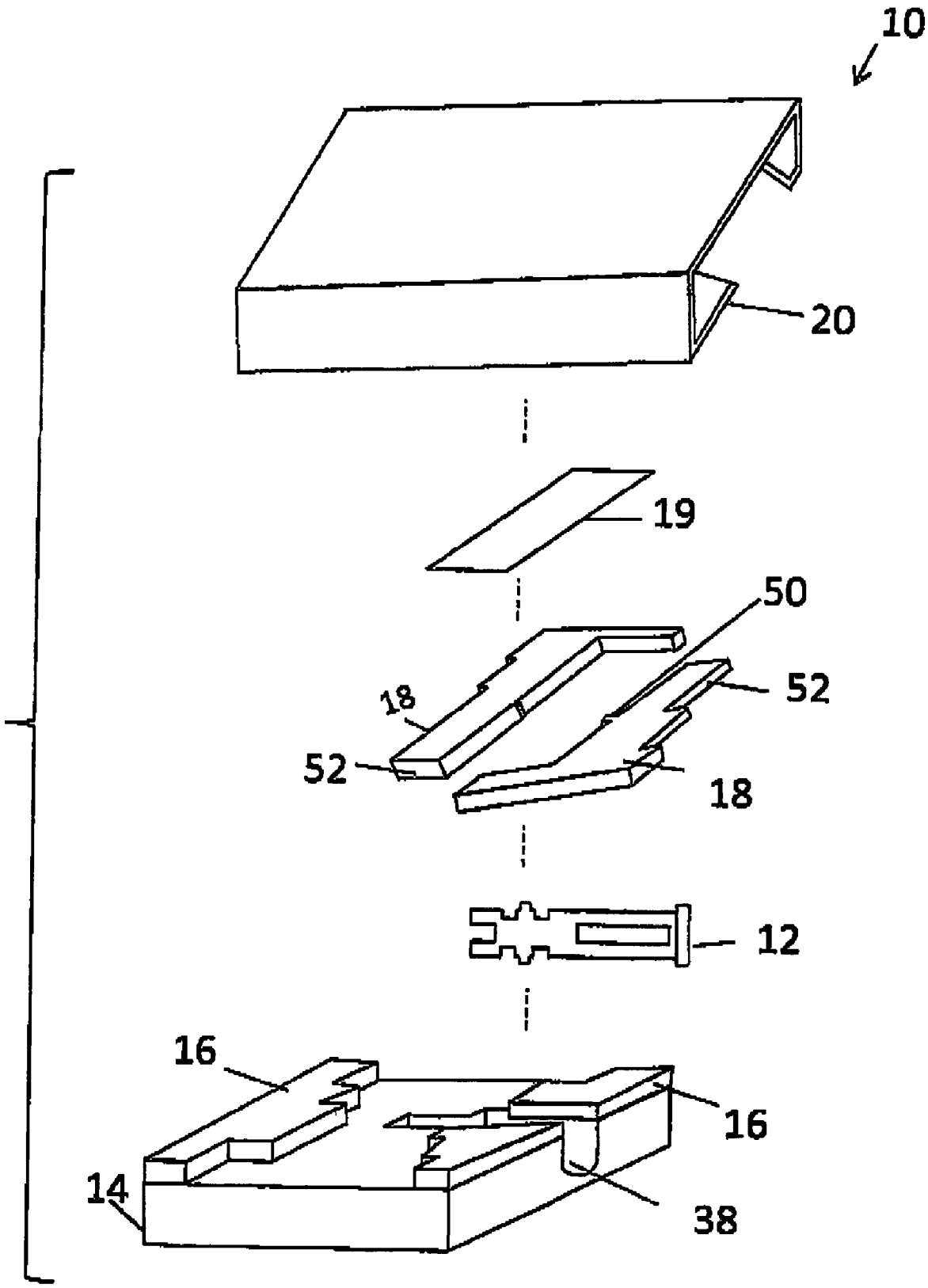
Figure 1C:
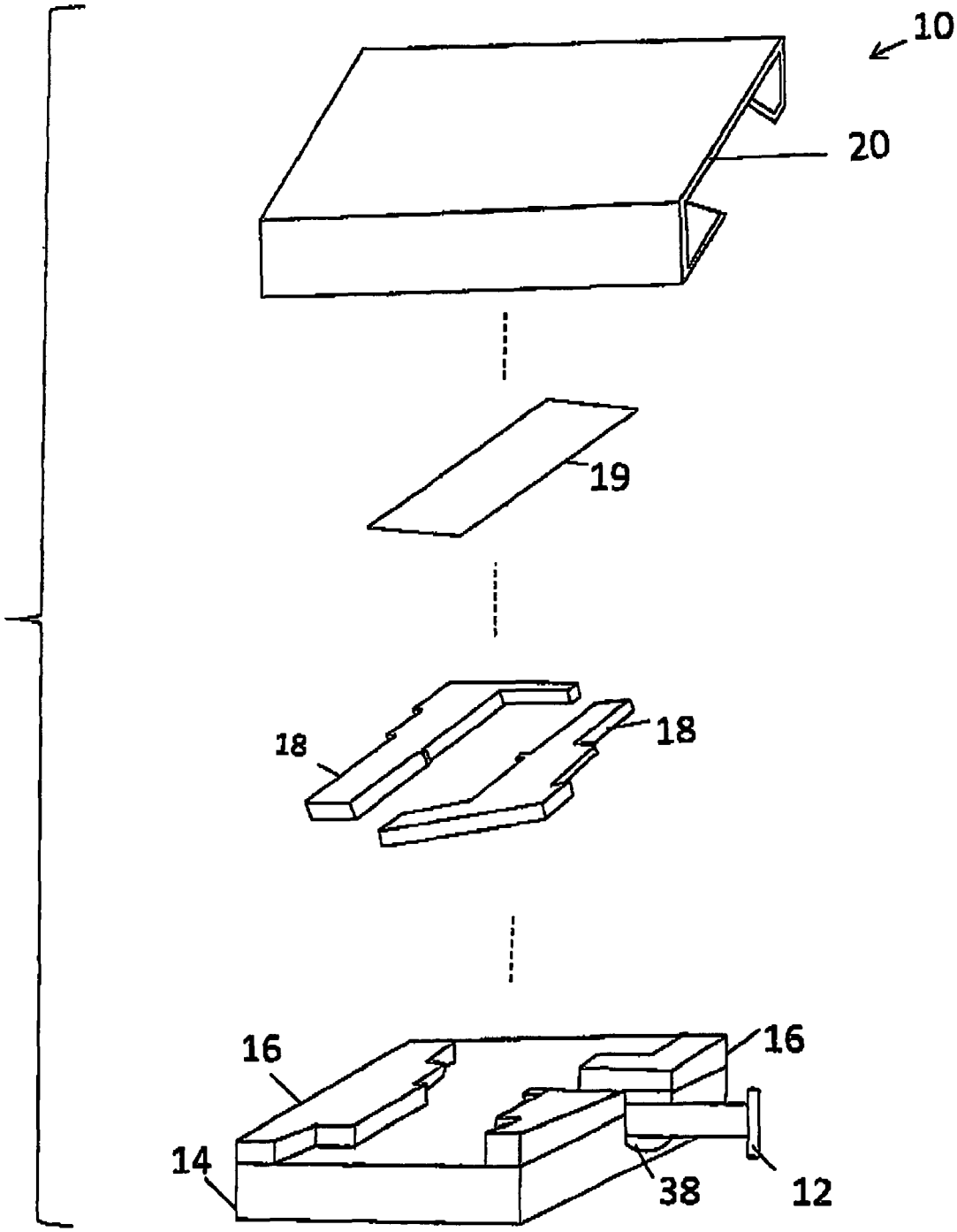
Figure 1D:
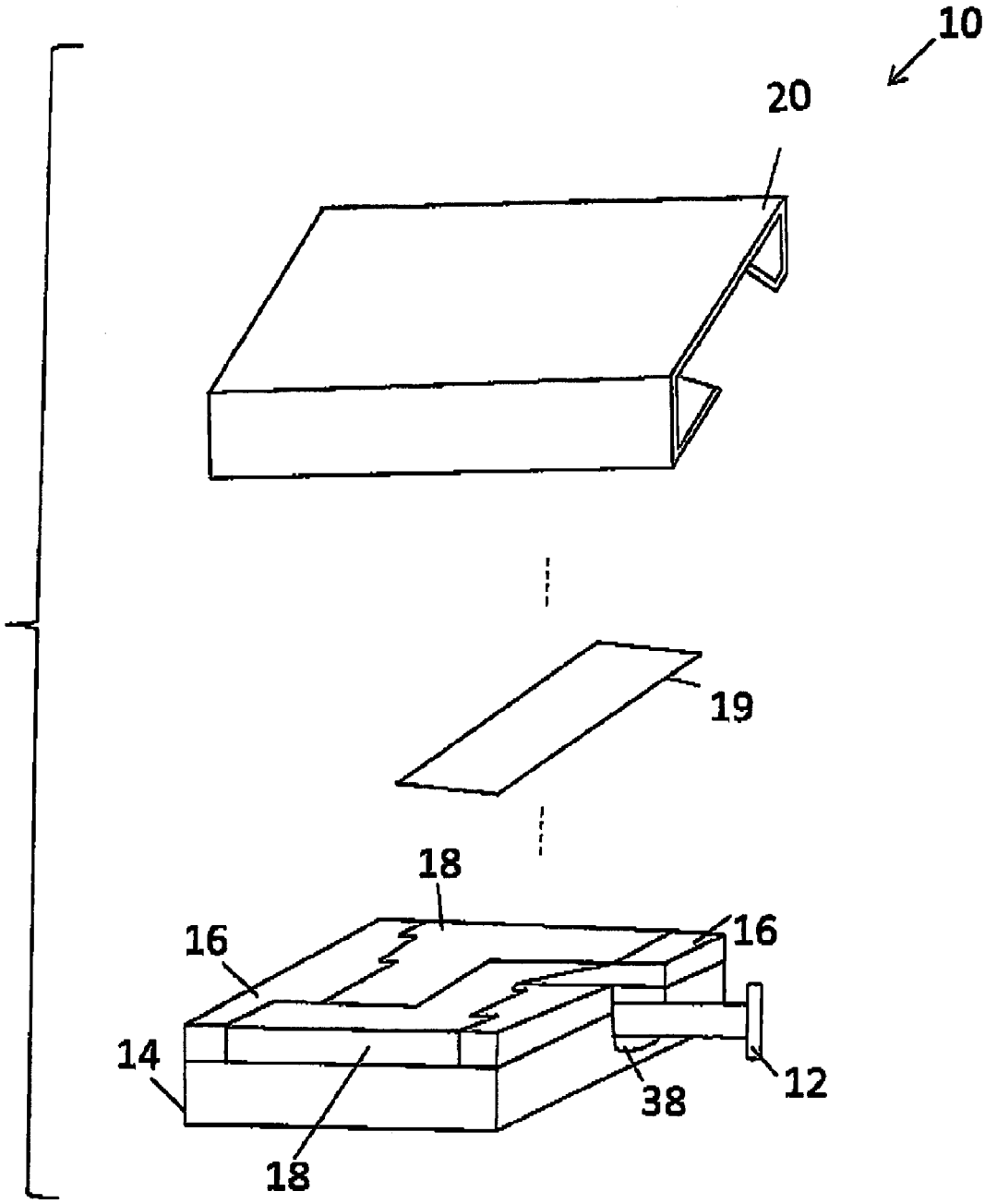
Figure 1E:
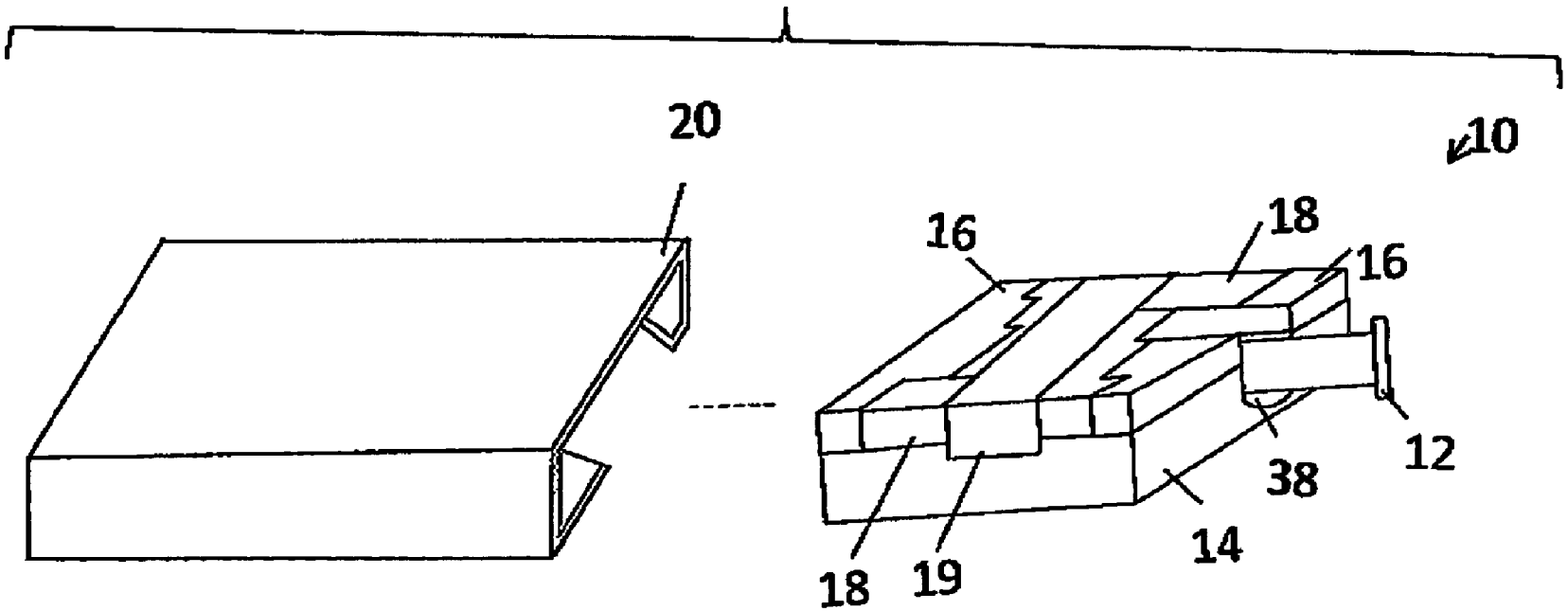
Figure 1F:
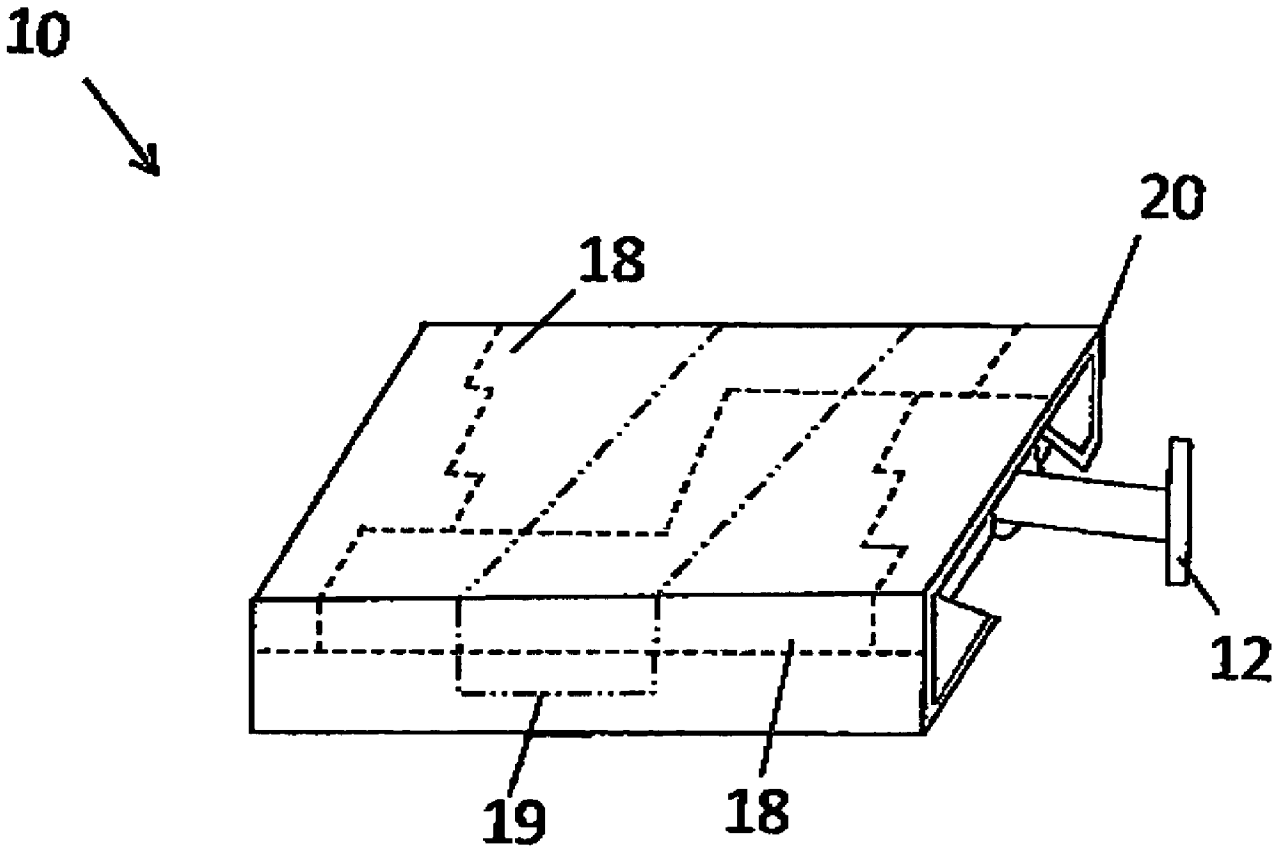

The present invention is a device to secure a cargo container or door of a truck against tampering.

The present invention is designed to be reusable while providing a high level of tamper protection.

FIGS. 1A-1F show the engagement of all the pieces necessary for a reusable tamper-evident cargo seal 10 according to the present invention. The tamper-evident cargo seal 10 has a pin 12, a body member 14, two parallel guides 16, two or more removable security label blanks 18, a tamper indicating label 19, and a cover 20.

Figure 2:
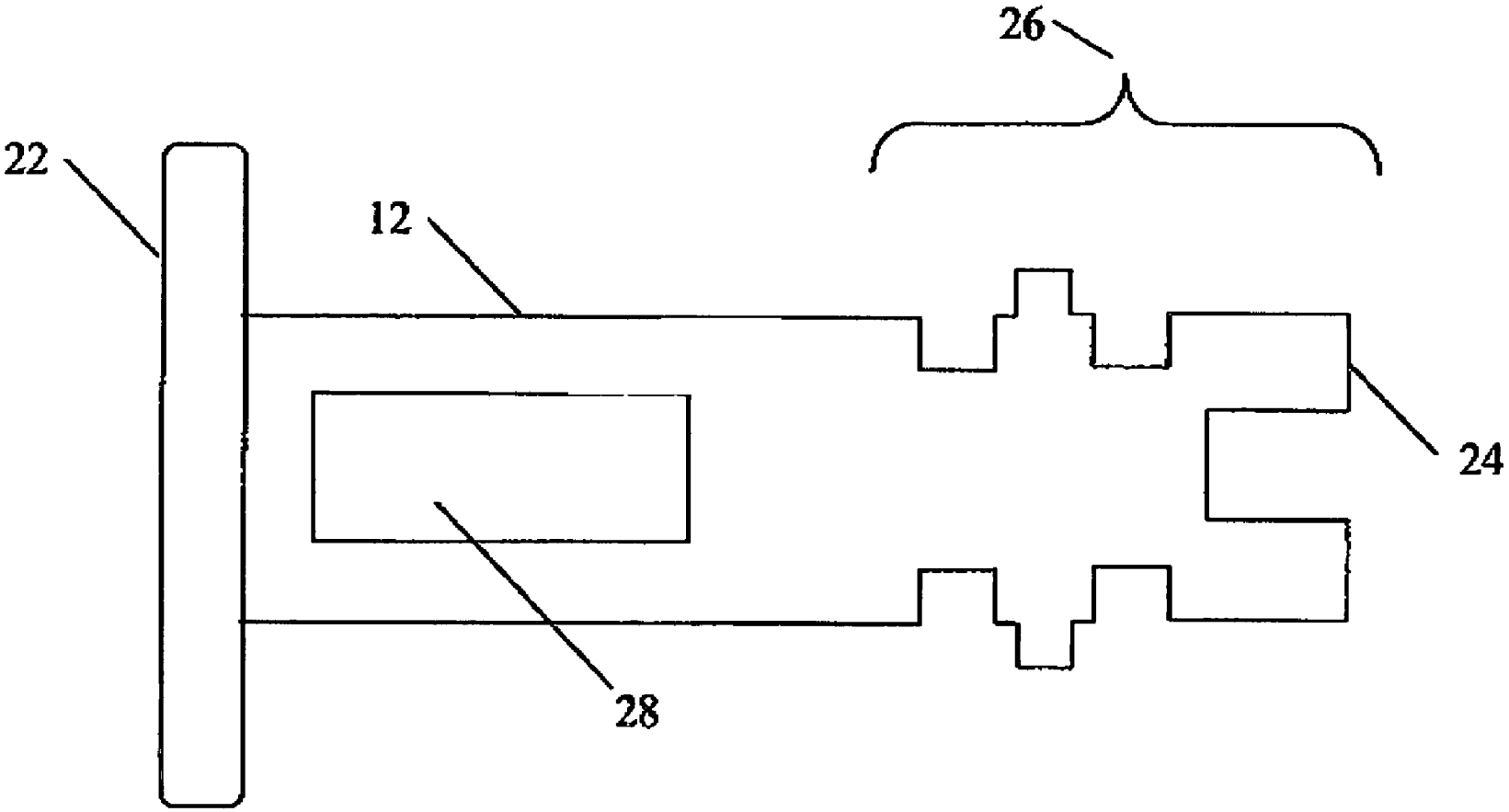
FIG. 2 is a top view of the pin used in the present invention.

Referring to FIG. 2, the pin 12 has a first end 22, a second end 24, and at least one identifier 28. The first end 22 is separated from the second end 24 a user-definable distance, and the second end 24 has a user-definable keying pattern 26. The at least one identifier 28 can include printed code, a holographic image, a Radio Frequency Identification tag, a magnetic strip, a capacitive sensor, a user-definable indicia, and any combination thereof. In an alternate embodiment (not shown), the pin 12 is "L" shaped. Persons skilled in the art will recognize that in practice, the user-definable distance of the pin 12 is selected to be any length that is at least long enough to easily insert the pin 12 through the hasp.

In the preferred embodiment, the pin 12 is made of plastic. Other materials may be used to manufacture the pin 12, such as steel, copper, titanium, aluminum, wood, fiberglass, aramid fiber, acrylic resin, composite fiber, and any combination thereof.

Figure 3:
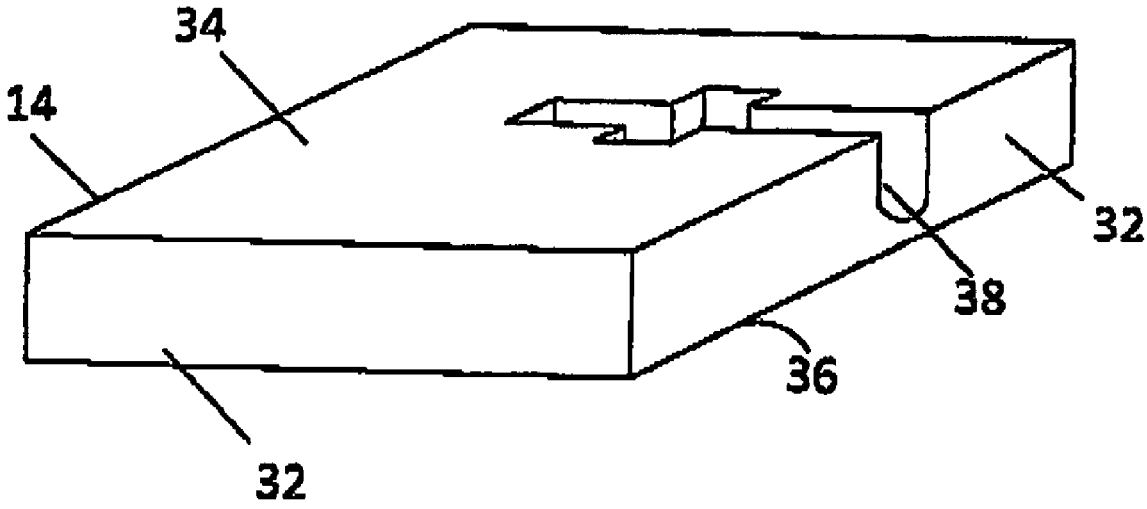
FIG. 3 is a perspective view of the body member of the present invention.

Referring to FIG. 3, the body member 14 has one or more side surfaces 32, a top surface 34, and a bottom surface 36. At least one of the one or more side surfaces 32 has one or more slots 38 through the side surface 32 extending from the top surface 34 to a user-definable distance from the bottom surface 36 and extending a user-definable distance into the interior of the body member 14. The slot 38 extends into the interior of the body member 14 and is shaped to accept said second end 24 of the pin 12 which has a user-definable keying.

The body member 14 may be any geometric shape, however, square or rectangular shapes are preferred. A rectangular shape is shown in the illustrations, and using this example, the body member has four side surfaces 32.

In the preferred embodiment, the body member 14 is made of plastic. Other materials may be used to manufacture the body member 14, such as steel, copper, titanium, aluminum, wood, fiberglass, aramid fiber, acrylic resin, composite fiber, and any combination thereof.

Figure 4:
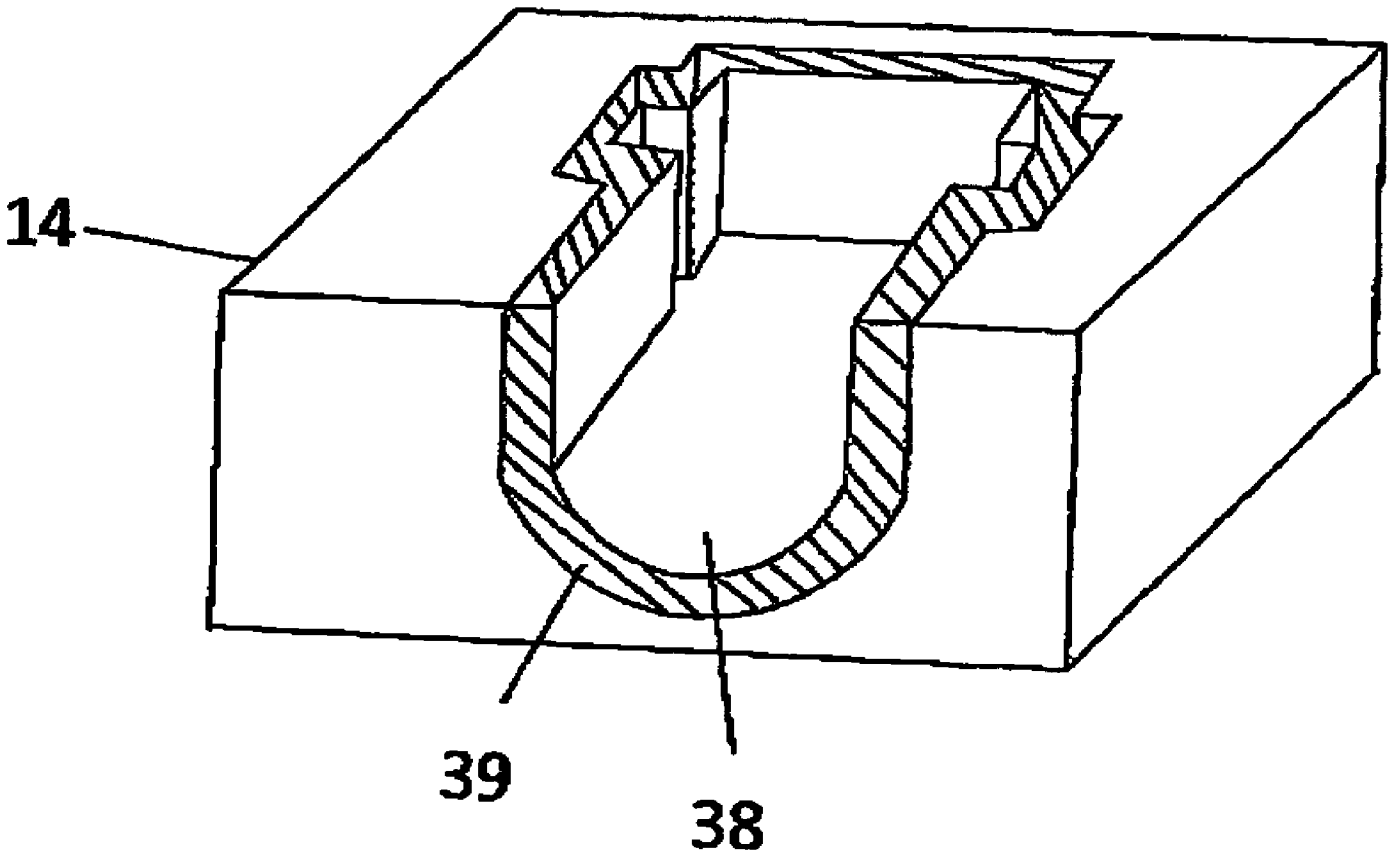
FIG. 4 is a perspective view of the body member of the present invention.

In an alternate embodiment, shown in FIG. 4, a higher strength material insert 39 is added to the body member 14 to strengthen the body member 14 from high tension loads. Preferably, the higher strength material insert 39 is added around the user-definable keying, but it could also be added to the interior of the body member 14. By way of example, if the body member 14 was made of plastic, a steel insert could be inserted during the molding process.

Abutting the top surface 34 of the body member 14 are two parallel guide members 16, as shown FIGS. 1A-1F, that are affixed to the body member 14. The parallel guide members 16 abutting the top surface 34 of the body member 14 and a portion of the one or more side surfaces 32 form a user-definable area between the two parallel guide members 16 and the one or more side surfaces 32. In the example of a rectangular body member 14, the area formed is a rectangle bound by the two parallel guide members 16 and the two side surfaces 32 perpendicular to the two parallel guide members 16.

One of the two parallel guide members 16 must lie directly over the at least one slot 38 through the side surface 32 of the body member 14 and have a slot for the pin 12 to pass through the guide member 16. In use, the user will insert the pin 12 into the body member 14, and thus the parallel glide member 16 must have a slot sized to permit the pin to pass through the guide member 16 and into the body member 14.

In an alternate embodiment, the two parallel guide members 16 are joined together with perpendicular members extending along a portion of the tops of the guide members 16. In this way, the connected two parallel guide members 16 are easier to affix to the body member 14, but still permits application of the tamper indicating label 19 described below.

In an alternate embodiment, the tamper-evident cargo seal is made as a single piece. Those persons skilled in the art will recognize that injection molding, casting, or machining can be used to make the body member 14 and the two parallel guide members 16 as a single piece.

In an alternate embodiment, the body member 14 further comprises one or more identifiers, such as a printed code, a holographic image, a Radio Frequency Identification tag, a magnetic strip, a capacitive sensor, a user-definable indicia, and any combination thereof.

Referring again to FIGS. 1A-1F, at least two removable security label blanks 18, having a user-definable thickness and a user-definable shape, are slideably positioned on top of the body member 14 and between the two parallel guide members 16, and cover substantially the entire area bound by the two parallel guide members 16 and the one or more side surfaces 32.

In an embodiment using two removable security blanks 18 as shown in FIGS. 1A-1F, each of the removable security blanks 18 are identical and cover approximately half of the area bound by the two parallel guide members 16 and the one or more side surfaces 32. Additionally, each of the two removable security blanks 18 have one or more protrusions 50 on the abutting surface 52 of the two removable security blanks 18. In this embodiment, the two removable security blanks 18 are designed to "snap" together. This feature keeps the halves from sliding out before the tamper indicating security label (described below) is applied. Using this embodiment of the present invention, one removable security blank 18 is slideably inserted in one direction between the parallel guide members 16 and then the second removable security blank 18 is inserted from the opposing longitudinal direction (the second removable security blank is flipped end for end) between the parallel guide members 16 such that it 'snaps' the second removable security blank 18 in place.

Preferably, a tamper indicating label 19 is affixed to the removable security label blanks 18 after being inserted between the two parallel guide members 16, securing the removable security label blanks 18 in place.

After the first use, the removable security label blanks 18 may be reversed, permitting a second, subsequent use of the removable security label blanks 18. Used removable security label blanks 18 may be discarded after use, saved for a user-definable time period, or cleaned of the old tamper indicating label 19 and reused.

In the preferred embodiment, the security label blank 18 is made of plastic. Other materials may be used to manufacture the security label blank 18, such as steel, copper, titanium, aluminum, wood, fiberglass, aramid fiber, acrylic resin, composite fiber, and any combination thereof.

In another alternate embodiment, the two parallel guide members 16 have a user-definable keying and the one or more removable security label blank 18 has a corresponding keying to permit one-way insertion of the one or more removable security label blanks 18.

Finally, as shown in FIGS. 1A-1F, the cargo seal 10 of the present invention includes a cover 20, which slideably extends over the top surface 34 of the body member 14 with its abutting two parallel guide members 16, a portion of the one or more side surfaces 32, and substantially covering the removable security blanks 18.

In the preferred embodiment, the cover 20 is made of plastic. Other materials may be used to manufacture the cover 20, such as steel, copper, titanium, aluminum, wood, fiberglass, aramid fiber, acrylic resin, composite fiber, and any combination thereof.

In an alternate embodiment, a portion of the bottom surface 36 is removed and the cover 20 extends a user-definable distance over the bottom surface 36.

To use the cargo seal 10 of the present invention, cargo is loaded into the container or truck and the doors closed. After securing the hasp, the pin 12 is inserted through the opening in the hasp. The pin 12 is positioned and slid into the body member 14 of the device, which may be serialized. Note that this sliding action is perpendicular to the axis of the rod, which is different from prior art methods. At least two removable security label blanks 18 are inserted between the parallel guides 16 abutting the top surface 34 of the body member 14. The removable security label blanks 18 cover the pin 12 and block the opening preventing the release of the pin 12 from the body member 14. When two removable security label blanks 18 are used, each covers half of the area and the removable security label blanks 18 interlock. A serialized tamper indicating label 19 is placed over the removable security label blanks 18 securing the removable security label blanks 18. A simple cover 20 is placed over the body 14, removable security label blanks 18, and tamper indicating label 19 to offer protection from elements. When a user wishes to enter the container, the user slits the tamper indicating label 19 along the edge of the removable security label blanks 18 and slides the removable security label blanks 18 out. The pin 12 is then removed from the body member 14. The parts may then be inspected for tampering or substitution. The removable security label blanks 18 can then be flipped over and re-used if desired.

In addition to the advantages mentioned above, the present invention is reusable, completely inspectable (nothing hidden) when inspecting for tampering or substitution, uses a cover 20 for protection, allows customizing the pin 12 for different users and applications, can be designed so the pin 12 can rotate or designed so it cannot rotate, can be designed so only one (like a key) or if desired so two or more differing pins 12 (like a master key) can be used with the same body member 14, does not require bolt cutting tools to gain access to the inside of the container, provides layers of tamper indicating products, and finally, does not need to be retrofitted—the present invention uses existing hasps found on all trucks and containers.

While the preferred embodiments of the invention have been illustrated and described, it will be apparent to those of ordinary skill in the art that various changes and modifications may be made without deviating from the inventive concepts set forth above.

What is claimed is:

1. A tamper-evident cargo seal, comprising:

a) a pin, said pin having a first end and a second end, said first end separated from said second end a user-definable distance, and said second end having a user-definable keying;

b) a body member, said body member having at least one side surface, a top surface, and a bottom surface, said at least one side surface having at least one slot through the side surface extending from the top surface to a user-definable distance from the bottom surface and extending a user-definable distance into the interior of the body member, said slot extending into the interior of the body member shaped to accept said second end of said pin having a user-definable keying;

c) two parallel guide members having a user-definable keying, said parallel guide members affixed to and abutting the top surface of said body member and a portion of the at least one side surface forming a user-definable area between the two parallel guide members and the at least one side surface, at least one of said two parallel guide members abutting said at least one slot through the side surface of said body member such that said pin can pass through said guide member to said body member;

d) two removable security label blanks, each of said two removable security blanks having a user-definable thickness, a user-definable shape, at least one adjoining surface wherein said at least one adjoining surface further comprising at least one protrusion extending from said at least one adjoining surface, and a corresponding keying that engages said corresponding keying of the other removable security label blank and requires one-way insertion of each of said at least two removable security label blanks wherein each of said two removable security label blanks are inserted in opposing directions and are slideably positioned as a single unit on top of said body member and between said two parallel guide members, and covering substantially the entire area bound by the two parallel guide members and said at least one side surface; and e) a cover, said cover slideably extending over said top surface of said body member and abutting two parallel guide members, a portion of the at least one side surface, and substantially covering the two removable security label blanks.

2. The tamper-evident bolt seal of claim 1, wherein said body member is comprises a geometric shape.

3. The tamper-evident bolt seal of claim 2, wherein a security label is affixed to said two removable security label blanks and extending substantially between said two parallel guides and at least one side surface.

4. The tamper-evident bolt seal of claim 3, wherein said body member further comprises at least one identifier, where said at least one identifier is selected from the group of identifiers consisting of a printed code, a holographic image, a Radio Frequency Identification tag, a magnetic strip, a capacitive sensor, a user-definable indicia, and any combination thereof.

5. The tamper-evident bolt seal of claim 4, wherein said pin, said body member, said two parallel guide members, said two removable security label blanks, and said cover are constructed from a material selected from the group of materials consisting of steel, aluminum, copper, titanium, wood, plastic, fiberglass, aramid fiber, acrylic resin, composite fiber, and any combination thereof.

6. The tamper-evident bolt seal of claim 5, wherein said pin further comprises at least one identifier, where said at least one identifier is selected from the group of identifiers consisting of a printed code, a holographic image, a Radio Frequency Identification tag, a magnetic strip, a capacitive sensor, a user-definable indicia, and any combination thereof.

7. The tamper-evident bolt seal of claim 6, wherein said interior of the body member further comprises a higher-strength material insert, said higher-strength material insert strengthening said interior of the body member from high tension loads such that said interior of the body member is stronger than the exterior of said body member.

8. The tamper-evident bolt seal of claim 7, wherein said higher-strength material insert added to the interior of the body member surrounds a portion of the interior of said body member shaped to accept said second end of said pin having a user-definable keying.

9. The tamper-evident bolt seal of claim 1, wherein a security label is affixed to said two removable security label blanks and extending substantially between said two parallel guides and at least one side surface.

10. The tamper-evident bolt seal of claim 1, wherein said body member further comprises at least one identifier, where said at least one identifier is selected from the group of identifiers consisting of a printed code, a holographic image, a Radio Frequency Identification tag, a magnetic strip, a capacitive sensor, a user-definable indicia, and any combination thereof.

11. The tamper-evident bolt seal of claim 1, wherein said pin, said body member, said two parallel guide members, said two removable security label blanks, and said cover are constructed from a material selected from the group of materials consisting of steel, aluminum, copper, titanium, wood, plastic, fiberglass, aramid fiber, acrylic resin, composite fiber, and any combination thereof.

12. The tamper-evident bolt seal of claim 1, wherein said pin further comprises at least one identifier, where said at least one identifier is selected from the group of identifiers consisting of a printed code, a holographic image, a Radio Frequency Identification tag, a magnetic strip, a capacitive sensor, a user-definable indicia, and any combination thereof.

13. The tamper-evident bolt seal of claim 1, wherein said interior of the body member further comprises a higher-strength material insert, said higher-strength material insert strengthening said interior of the body member from high tension loads such that said interior of the body member is stronger than the exterior of said body member.

14. The tamper-evident bolt seal of claim 13, wherein said higher-strength material insert added to the interior of the body member surrounds a portion of the interior of said body member shaped to accept said second end of said pin having a user-definable keying.

* * * * *